US010994178B1

(12) United States Patent
Janus, Sr. et al.

(10) Patent No.: US 10,994,178 B1
(45) Date of Patent: May 4, 2021

(54) FREESTANDING GOLF PUTTER WITH ROUNDED CLUBFACE

(71) Applicants: David Michael Janus, Sr., Harvey's Lake, PA (US); David Michael Janus, Jr., Harvey's Lake, PA (US); Theresa Ann Janus, Harvey's Lake, PA (US)

(72) Inventors: David Michael Janus, Sr., Harvey's Lake, PA (US); David Michael Janus, Jr., Harvey's Lake, PA (US); Theresa Ann Janus, Harvey's Lake, PA (US)

( * ) Notice: Subject to any disclaimer, the term of this patent is extended or adjusted under 35 U.S.C. 154(b) by 0 days.

(21) Appl. No.: 16/731,375

(22) Filed: Dec. 31, 2019

(51) Int. Cl.
*A63B 53/04* (2015.01)
*A63B 53/00* (2015.01)
*A63B 102/32* (2015.01)

(52) U.S. Cl.
CPC ..... *A63B 53/0487* (2013.01); *A63B 53/007* (2013.01); *A63B 2102/32* (2015.10)

(58) Field of Classification Search
CPC ..... A63B 53/0487; A63B 53/007; A63B 2102/32; A63B 53/065
USPC ..... 473/313, 314, 340, 341, 293, 330, 473/305–307, 251, 255; D21/736
See application file for complete search history.

(56) References Cited

U.S. PATENT DOCUMENTS 3,675,923 A * 7/1972 Allen ..... A63B 53/007 473/313
4,141,556 A * 2/1979 Paulin ..... A63B 53/007 473/253
4,290,606 A * 9/1981 Maxwell ..... A63B 53/007 273/129 K
4,871,174 A * 10/1989 Kobayashi ..... A63B 53/0487 473/252
4,964,639 A * 10/1990 Tucker ..... A63B 53/007 473/255
5,125,664 A * 6/1992 Evans ..... A63B 69/3685 434/252
5,160,141 A * 11/1992 Crews ..... A63B 53/02 473/313
5,282,622 A * 2/1994 Evans ..... A63B 69/3685 473/243
5,580,058 A * 12/1996 Coughlin ..... A63B 69/3685 273/250
5,630,765 A * 5/1997 Moore ..... A63B 53/0487 473/252
5,830,078 A * 11/1998 McMahan ..... A63B 60/02 473/252
5,924,938 A * 7/1999 Hines ..... A63B 53/02 473/307
5,993,324 A * 11/1999 Gammil ..... A63B 53/0487 473/251
6,524,193 B1 2/2003 Devore
(Continued)

*Primary Examiner* — Sebastiano Passaniti
(74) *Attorney, Agent, or Firm* — Innocordia Patent Law PLLC; Douglas E. Agopsowicz

(57) ABSTRACT

A putter head for a freestanding golf putter includes: a cylindrical leading portion including a heel end, a toe end, an axis that extends through a center of the heel end and a center of the toe end in a first direction, and a rounded exterior surface that extends from the heel end to the toe end, the rounded exterior surface including a front face and a rear face; and a trailing portion including: a center arm that extends rearwardly from a center portion of the rear face in a second direction that is perpendicular to the first direction; a heel arm that extends rearwardly and inwardly towards the center arm from a first lateral portion of the rear face; and a toe arm that extends rearwardly and inwardly towards the center arm from a second lateral portion of the rear face.

12 Claims, 4 Drawing Sheets

(56) References Cited

U.S. PATENT DOCUMENTS

| | | | | |
|---|---|---|---|---|
| 6,634,956 | B1 * | 10/2003 | Pegg | A63B 53/0487 473/251 |
| 6,767,293 | B2 * | 7/2004 | Pechter | A63B 53/0487 473/313 |
| 6,796,911 | B2 * | 9/2004 | Grace | A63B 53/0487 473/251 |
| 6,958,019 | B2 | 10/2005 | Rohrer | |
| 7,169,058 | B1 * | 1/2007 | Fagan | A63B 60/00 473/293 |
| 7,326,121 | B2 * | 2/2008 | Roake | A63B 60/02 473/251 |
| 7,431,660 | B2 * | 10/2008 | Hasegawa | A63B 53/0487 473/251 |
| 7,607,991 | B2 * | 10/2009 | Sorenson | A63B 53/0487 473/313 |
| D621,460 | S * | 8/2010 | Serrano | D21/742 |
| D621,891 | S * | 8/2010 | Serrano | D21/742 |
| 8,128,505 | B2 * | 3/2012 | Tryner | A63B 53/0487 473/242 |
| 9,168,438 | B2 * | 10/2015 | Boyd | A63B 60/00 |
| 9,694,260 | B1 * | 7/2017 | Abbott | A63B 60/00 |
| 10,052,536 | B1 | 8/2018 | Janus, Sr. et al. | |
| 10,384,103 | B1 * | 8/2019 | Yoon | A63B 53/007 |
| 2004/0053703 | A1 * | 3/2004 | Snyder | A63B 53/007 473/243 |
| 2006/0030423 | A1 * | 2/2006 | Lindsay | A63B 53/0487 473/313 |
| 2006/0223649 | A1 * | 10/2006 | Rife | A63B 60/02 473/334 |
| 2007/0238547 | A1 * | 10/2007 | Jones | A63B 60/02 473/340 |

* cited by examiner

FREESTANDING GOLF PUTTER WITH ROUNDED CLUBFACE

TECHNICAL FIELD

The disclosed subject matter relates to putter heads and golf putters.

BACKGROUND

In the game of golf, about half of all strokes are expected to be played on the putting green using a putter. Typically, great care is taken to properly aim before attempting a putt in order to reduce the total number of strokes in a game. For example, a golfer may stand behind his or her golf ball to determine an appropriate target or trajectory in order to successfully strike the ball into the hole based on the position of the ball and the topography of the green. However, when the golfer returns to the ball to attempt the putt, he or she must take aim yet again based on a different viewing angle than from directly behind the ball. As a result, the clubface of the putter might not be properly aimed toward the intended target, leading to missed putts. Furthermore, even if the clubface is properly aimed, conventional putter designs using a flat club face may cause a golf ball to skid or bounce when struck and deviate from the intended target or trajectory. This in turn may lead to additional strokes and/or frustration for the golfer.

Accordingly, it is desirable to provide new designs for putter heads and golf putters.

SUMMARY

Putter heads and golf putters are provided. In accordance with some embodiments of the disclosed subject matter, a putter head for a freestanding golf putter is provided, the putter head comprising: a cylindrical leading portion comprising a heel end, a toe end, an axis that extends through a center of the heel end and a center of the toe end in a first direction, and a rounded exterior surface that extends from the heel end to the toe end, wherein the rounded exterior surface comprises a front face and a rear face; and a trailing portion comprising: a center arm that extends rearwardly from a center portion of the rear face in a second direction that is perpendicular to the first direction; a heel arm that extends rearwardly and inwardly from a first lateral portion of the rear face adjacent to the heel end; a toe arm that extends rearwardly and inwardly from a second lateral portion of the rear face adjacent to the toe end; and a base at which the center arm, the heel arm, and the toe arm are integrally formed, at least a portion of the front face forms a striking face for contacting a golf ball.

In some embodiments, the heel arm comprises a first outer lateral edge and a first rear edge, wherein the toe arm comprises a second outer lateral edge and a second rear edge.

In some embodiments, the first outer lateral edge, the first rear edge, the second rear edge, and the second outer lateral edge are straight edges.

In some embodiments, the trailing portion further comprises: a first convex angle at an intersection of the first outer lateral edge and the first rear edge; and a second convex angle at an intersection of the second outer lateral edge and the second rear edge.

In some embodiments, the trailing portion further comprises a concave angle at an intersection of the first rear edge and the second rear edge.

In some embodiments, the trailing portion further comprises: a first convex angle at an intersection of the first outer lateral edge and the first rear edge; a second convex angle at an intersection of the second outer lateral edge and the second rear edge; and a concave angle at an intersection of the first rear edge and the second rear edge, wherein the first outer lateral edge, the first rear edge, the second rear edge, and the second outer lateral edge are straight edges.

In some embodiments, the putter head further comprises a stem arranged on the center arm.

In some embodiments, the putter head further comprises a stem arranged on the heel arm or the toe arm.

In some embodiments, at least one alignment line is arranged on at least one of the leading portion and the trailing portion and parallel to the second direction.

In accordance with some embodiments of the disclosed subject matter, a freestanding golf putter is provided, the freestanding golf putter comprising: a putter head comprising: a cylindrical leading portion comprising a heel end, a toe end, an axis that extends through a center of the heel end and a center of the toe end in a first direction, and a rounded exterior surface that extends from the heel end to the toe end, wherein the rounded exterior surface comprises a front face and a rear face; and a trailing portion comprising: a center arm that extends rearwardly from a center portion of the rear face in a second direction that is perpendicular to the first direction; a heel arm that extends rearwardly and inwardly from a first lateral portion of the rear face adjacent to the heel end; a toe arm that extends rearwardly and inwardly from a second lateral portion of the rear face adjacent to the toe end; a base at which the center arm, the heel arm, and the toe arm are integrally formed, at least a portion of the front face forms a striking face for contacting a golf ball; a stem arranged on the center arm, the heel arm, or the toe arm; and a shaft coupled to the stem.

BRIEF DESCRIPTION OF THE DRAWINGS

Various objects, figures, and advantages of the disclosed subject matter can be more fully appreciated with reference to the following detailed description of the disclosed subject matter when considered in connection with the following drawings, in which like reference numerals identify like elements.

DETAILED DESCRIPTION

In accordance with various embodiments, putter heads and putters are provided.

It is noted that numerical values recited herein are modified by the term "about," whether or not expressly stated. As used herein, the term "about" defines the numerical boundaries of the numerical value so as to include, but not be limited to, tolerances and values up to and including the modified numerical value. That is, numerical values can include the actual value that is expressly recited as well as a range of other values that one of ordinary skill in the art would consider equivalent to the recited numerical value (i.e., having the same function or result).

Figure 1:
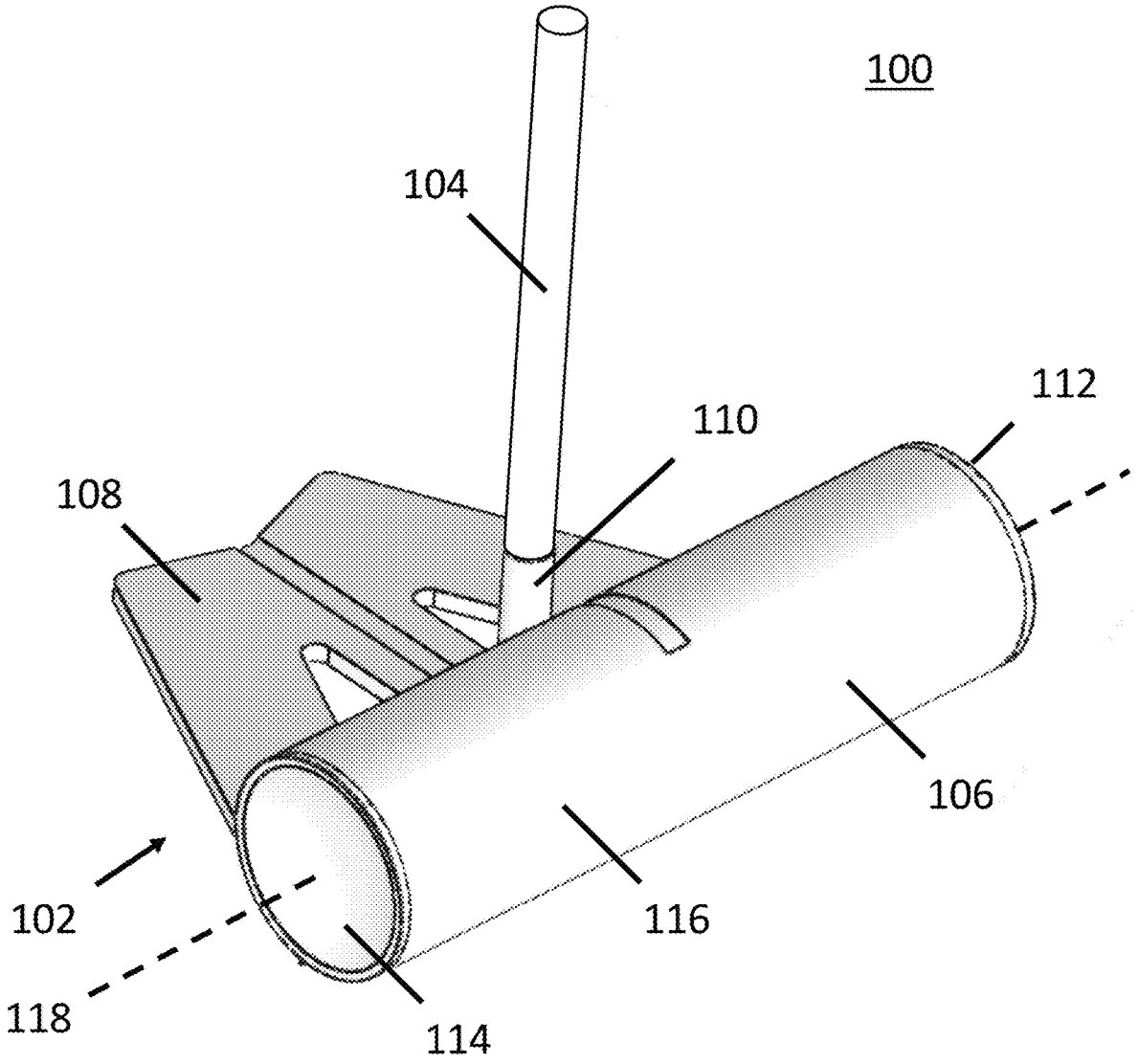
FIG. 1 shows an example of a perspective view of a freestanding golf putter in accordance with some embodiments of the disclosed subject matter.

Turning to FIG. 1, an example of freestanding golf putter 100 in accordance with some embodiments of the disclosed subject matter is shown. As illustrated, in some embodiments, golf putter 100 can include putter head 102 and shaft 104.

In some embodiments, putter head 102 can include leading portion 106, trailing portion 108, and stem 110.

In some embodiments, leading portion 106 can be any suitable shape and/or size. For example, in some embodiments, leading portion 106 can be a circular cylindrical tube. As a more particular example, in some embodiments, leading portion 106 can be a circular cylindrical tube having an outside diameter in the range of 1.25 inches to 2 inches, a length of 5.5 inches, and/or a thickness of 0.0625 inches.

In some embodiments, leading portion 106 can include heel end 112 and toe end 114. In some embodiments, heel end 112 and toe end 114 can be any suitable shape and/or size. For example, in some embodiments, heel end 112 and toe end 114 can be substantially flat circles. As another example, in some embodiments, heel end 112 and toe end 114 can be conical and concave. As a more particular example, in some embodiments, heel end 112 and toe end 114 can be conical and concave having a depth of ⅛ inches.

In some embodiments, leading portion 106 can include rounded exterior surface 116. In some embodiments, rounded exterior surface 116 can be any suitable size and/or shape. For example, in some embodiments, rounded exterior surface 116 can extend from heel end 112 to toe end 114.

In some embodiments, leading portion 106 can include an axis 118 that extends through a center of heel end 112 and a center of toe end 114.

In some embodiments, leading portion 106 can include one or more weights (not shown). In some embodiments, the one or more weights can be any suitable size and/or shape and can have any suitable arrangement in leading portion 106. For example, in some embodiments, a respective weight can be arranged within leading portion 106 at heel end 112 and toe end 114. As another example, in some embodiments, a weight can be arranged within leading portion 106 at the center along the length of leading portion 106 from heel end 112 to toe end 114.

Figure 2:
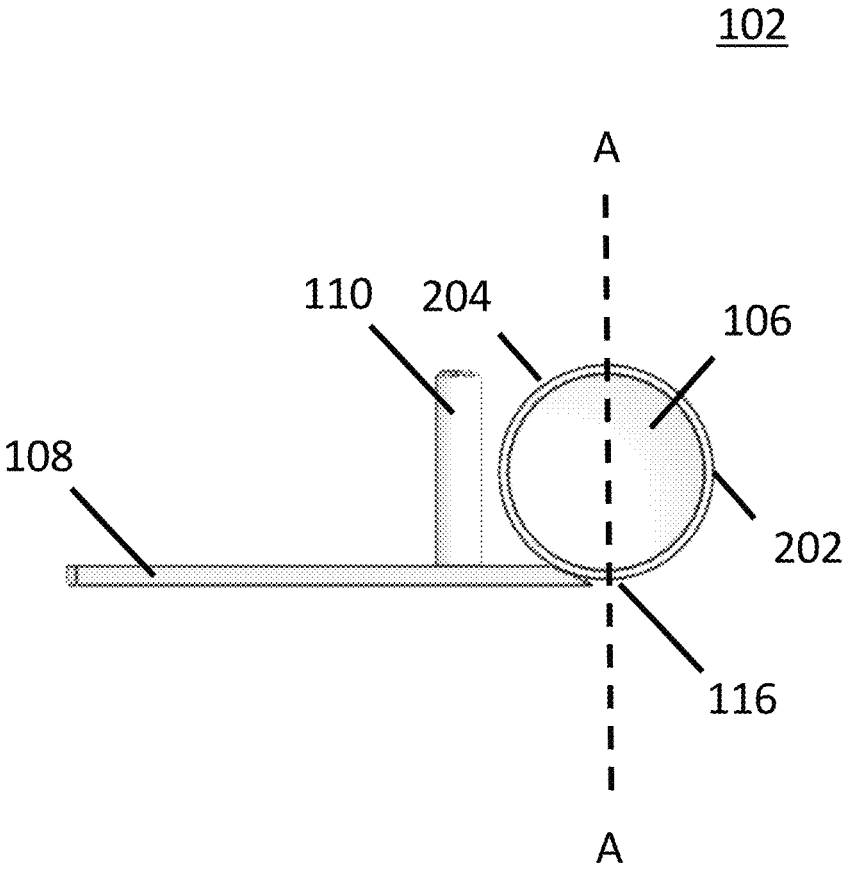
FIG. 2 shows an example of a side view of a putter head in accordance with some embodiments of the disclosed subject matter.

Turning to FIG. 2, an example of a side view of putter had 102 in accordance with some embodiments of the disclosed subject matter is shown. As illustrated, in some embodiments, rounded exterior surface 116 can include front face 202 and rear face 204.

In some embodiments, front face 202 can include any portion of rounded exterior surface 116 in the front half of leading portion 106, and rear face 202 can include any portion of rounded exterior surface 116 in the rear half of leading portion 106. For example, in some embodiments, front face 202 can include any portion of rounded exterior surface 116 to the right of imaginary line A-A, and rear face 204 can include any portion of rounded exterior surface 116 to the left of imaginary line A-A. In some embodiments, at least a portion of front face 202 can form a striking face for contacting a golf ball. In some embodiments, a rounded striking face provided by front face 202 can advantageously prevent a golf ball from skidding and/or bouncing when struck therewith.

Figure 3:
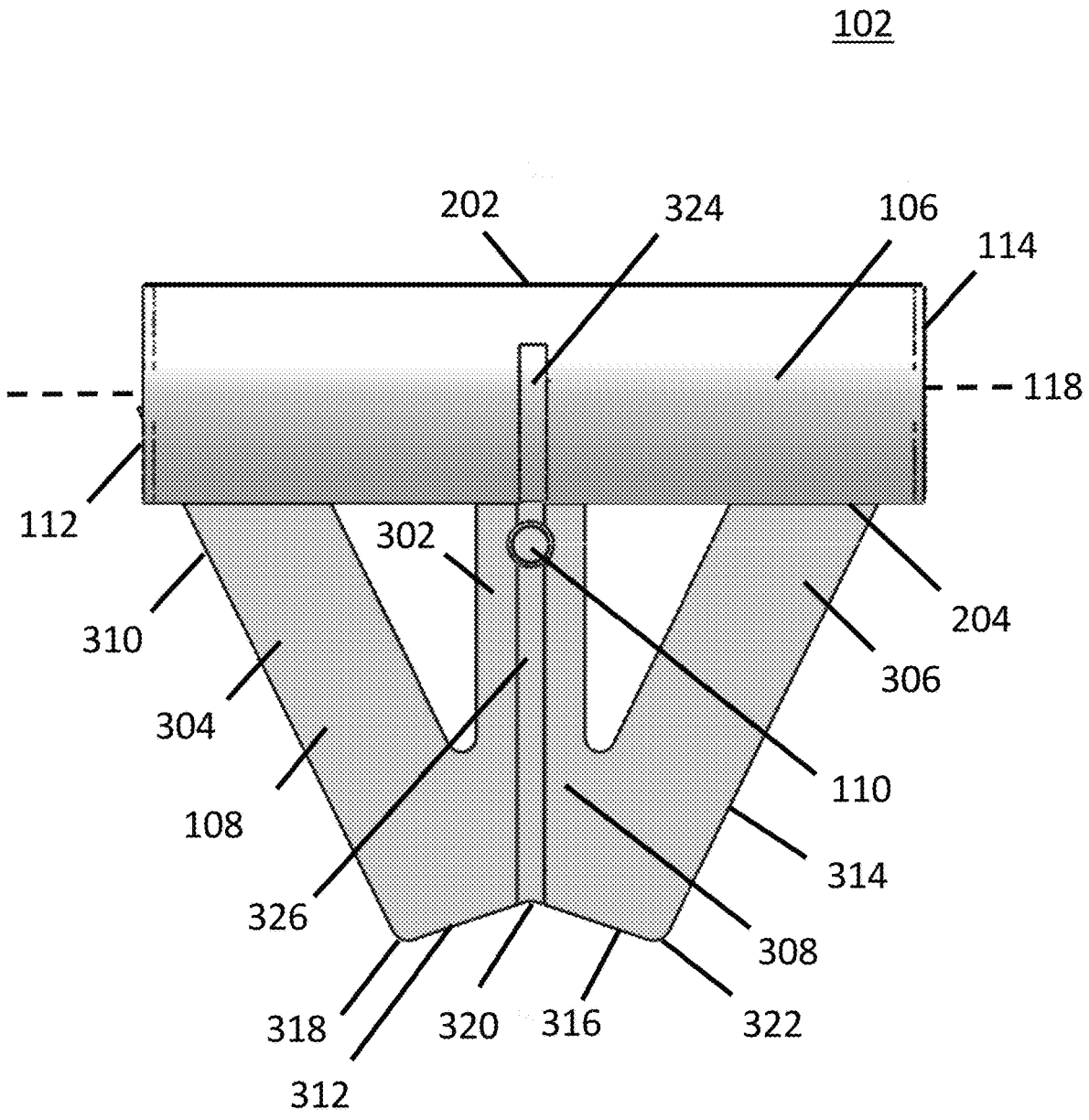
FIG. 3 shows an example of a plan view of a putter head in accordance with some embodiments of the disclosed subject matter.

Turning to FIG. 3, an example of a plan view of putter head 102 in accordance with some embodiments of the disclosed subject matter is shown. As illustrated, in some embodiments, trailing portion 108 can include center arm 302, heel arm 304, toe arm 306, and base 308. In some embodiments, heel arm 304 can include outer lateral edge 310 and rear edge 312, and toe arm 306 can include outer lateral edge 314 and rear edge 316.

In some embodiments, trailing portion 108 can be any suitable size and/or shape. For example, in some embodiments, trailing portion 108 can be a substantially flat plate. As a more particular example, in some embodiments, trailing portion 108 can be a substantially flat plate having a height of 0.125 inches.

In some embodiments, center arm 302, heel arm 304, toe arm 306, and base 308 can be any suitable size and/or shape. For example, in some embodiments, center arm 302, heel arm 304, and/or toe arm 306 can have a width of 0.75 inches and/or a height of 0.125 inches. In some embodiments, outer lateral edge 310, rear edge 312, outer lateral edge 314, and rear edge 316 can be straight edges.

In some embodiments, center arm 302, heel arm 304, and toe arm 306 can be integrally formed at base 308 such that trailing portion 108 forms a W-shape. For example, in some embodiments, trailing portion 108 can include convex angle 318 at an intersection of outer lateral edge 310 and rear edge 312, concave angle 320 at an intersection of rear edge 312 and rear edge 316, and convex angle 322 at an intersection of outer lateral edge 314 and rear edge 316. More specifically, as shown in FIG. 3, the center arm 302 extends rearwardly in a direction (also referred to as a "second direction") that is perpendicular to the axis 118 such that an end of the center arm 302 is located a predetermined distance away from the center portion of the bottom part of the rea face 204. The outer lateral edge 310 and the rear edge 312 intersect at a point located beyond the predetermined distance in the second direction, such that outer surfaces of the outer lateral edge 310 and the rear edge 312 form the convex angle 318 when viewed from a position facing the putter head 102 and lying beyond the predetermined distance in the second direction, and the outer lateral edge 314 and the rear edge 316 also intersect at a point located beyond the predetermined distance in the second direction, such that outer surfaces of the outer lateral edge 314 and the rear edge 316 from the convex angle 322 when viewed from the position. As a more particular example, in some embodiments, a distance between convex angle 318 and convex angle 322 can be 1.9 inches. Also, as shown in FIGS. 2 and 3, the center arm 302, the heel arm 304, the toe arm 306, and the base 308 each lie in a same two-dimensional plane such that, when the putter head 102 is placed on a putting surface, the two-dimensional plane is oriented parallel to the putting surface and the center arm 302, the heel arm 304, the toe arm 306, and the base 308 each contact the putting surface. In some embodiments, a W-shaped body provided by trailing portion 108 can advantageously increase stability of freestanding golf putter 100 on imperfect or uneven terrain. Additionally, the W-shaped body provided by putter head 102 can advantageously distribute the mass of putter head 102 laterally and increase rotational inertia in order to resist twisting during a putting stroke.

In some embodiments, leading portion 106 and trailing portion 108 can be coupled such that trailing portion 108 extends rearwardly from leading portion 106. For example, in some embodiments, center arm 302 can be coupled to a center portion along the bottom of rear face 204, heel arm 304 can be coupled to a lateral portion along the bottom of rear face 204 adjacent to heel end 112, and toe arm 306 can be coupled to a lateral portion along the bottom of rear face 204 adjacent to toe end 114. Accordingly, in some embodiments, center arm 302 can extend rearwardly from a center portion of rear face 204 in a direction perpendicular to axis 118, heel arm 304 can extend rearwardly and inwardly from a lateral portion of rear face 204 adjacent to heel end 112, and toe end 306 can extend rearwardly and inwardly from a lateral position of rear face 204 adjacent to toe end 114. In some embodiments, center arm 302, heel arm 304, and/or toe arm 306 can be coupled to rear face 204 using any suitable means.

In some embodiments, putter head 102 can include one or more alignment lines. For example, in some embodiments, putter head 102 can include alignment line 324 on leading portion 106 and/or alignment line 326 on center arm 302. In some embodiments, alignment line 324 and/or alignment line 326 can be formed along a center axis of putter head 102 and can extend in a direction perpendicular to axis 118.

In some embodiments, alignment line 324 and/or alignment line 326 can be formed on leading portion 106 and/or center arm 302 in any suitable manner, and alignment line 324 and alignment line 326 can have any suitable size and/or shape. For example, in some embodiments, alignment line 324 and/or alignment line 326 can be formed by etching, painting, and/or any other suitable means. As a more particular example, in some embodiments, alignment line 324 and/or alignment line 326 can be a groove etched in leading portion 106 and/or center arm 302 having a depth of 1/64 inches.

In some embodiments, stem 110 can be formed on center arm 302, heel arm 304, or toe arm 306 using any suitable means. In some embodiments, stem 110 can be any suitable size and/or shape. For example, in some embodiments, stem 110 can have an outer diameter of 0.3125 inches and/or a height in the range of 1.25 inches to 1.5 inches. When stem 110 is formed on center arm 302, shaft 104 can advantageously be used as another alignment tool when attached to stem 110 in some embodiments. Alternatively, stem 100 formed on heel arm 304 or toe arm 306 can provide more comfortable options for some right-handed or left-handed users, respectively.

In some embodiments, putter head 102 can be any suitable size and/or shape. For example, in some embodiments, putter head 102 can have a length in the range of 4.125 inches and 4.5 inches (in a direction perpendicular to axis 118), a width of 5.5 inches (in a direction parallel to axis 118), a height in the range of 1.25 inches to 1.5 inches, and/or a weight in the range of 14.5 to 14.9 ounces.

Figure 4:
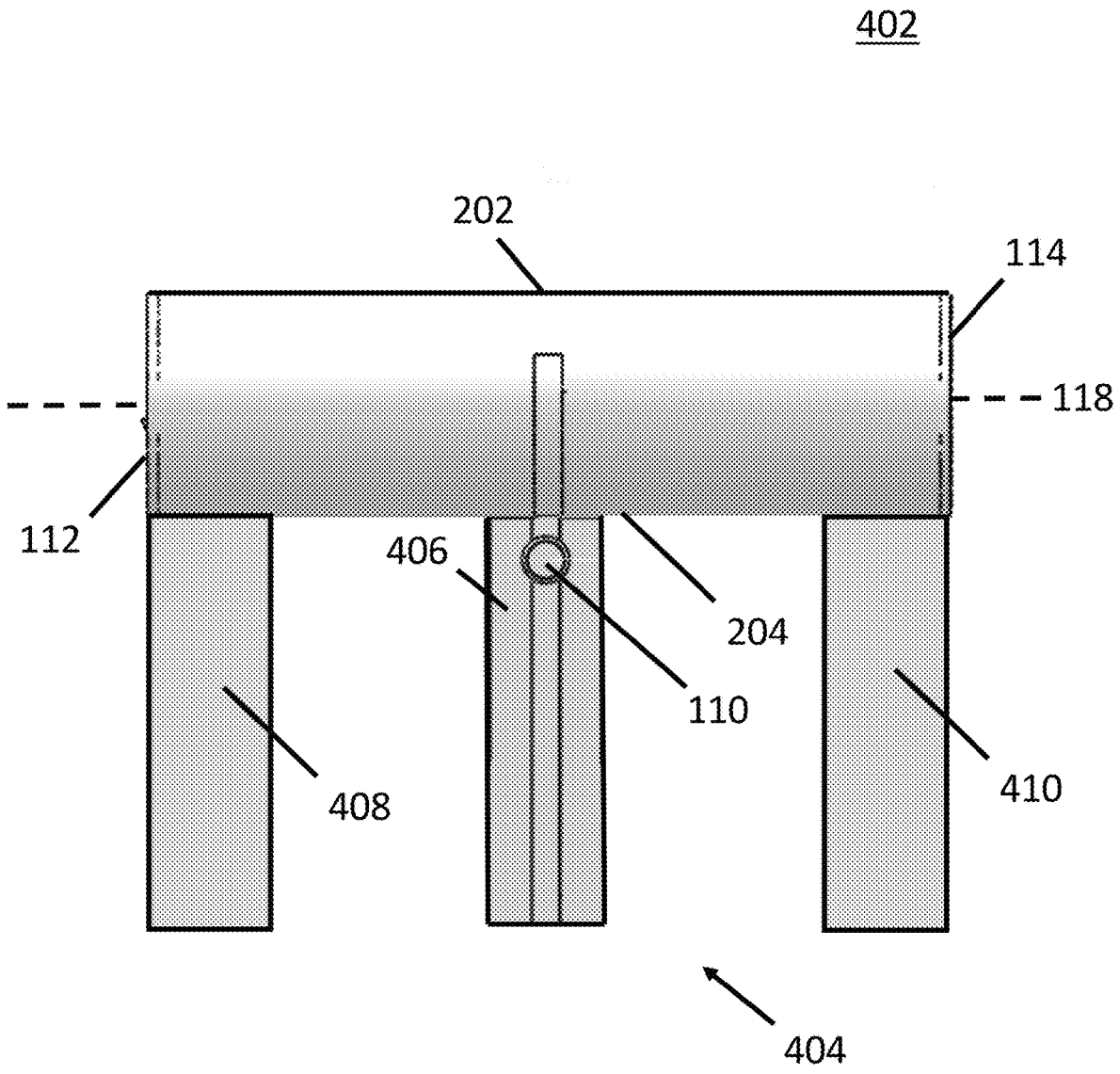
FIG. 4 shows an example of a plan view of another putter head in accordance with some embodiments of the disclosed subject matter.

Turning to FIG. 4, an example of a plan view of putter head 402 in accordance with some embodiments of the disclosed subject matter is shown. As illustrated, in some embodiments, trailing portion 404 can include center arm 406, heel arm 408, and toe arm 410.

In some embodiments, leading portion 106 and trailing portion 404 can be coupled such that trailing portion 404 extends rearwardly from leading portion 106. For example, in some embodiments, center arm 406 can be coupled to a center portion along the bottom of rear face 204, heel arm 408 can be coupled to a lateral portion along the bottom of rear face 204 adjacent to heel end 112, and toe arm 410 can be coupled to a lateral portion along the bottom of rear face 204 adjacent to toe end 114. Accordingly, in some embodiments, center arm 406 can extend rearwardly from a center portion of rear face 204 in a direction perpendicular to axis 118, heel arm 408 can extend rearwardly from a lateral portion of rear face 204 adjacent to heel end 112 in a direction perpendicular to axis 118, and toe end 410 can extend rearwardly from a lateral position of rear face 204 adjacent to toe end 114 in a direction perpendicular to axis 118. In some embodiments, center arm 406, heel arm 408, and/or toe arm 410 can be coupled to rear face 204 using any suitable means.

In some embodiments, center arm 406, heel arm 408, and toe arm 410 can be any suitable size and/or shape. For example, in some embodiments, center arm 406, heel arm 408, and/or toe arm 410 can have a length in the range of 3.25 inches to 3.5 inches (in a direction perpendicular to axis 118), a width of 0.75 inches (in direction parallel to axis 118) and/or a height of 0.125 inches. In some embodiments, center arm 406, heel arm 408, and 410 can be of equal length. Alternatively, in some embodiments, center arm 406 can be shorter or longer than heel arm 408 and toe arm 410.

In some embodiments, stem 110 can be formed on center arm 406, heel arm 408, or toe arm 410 using any suitable means. In some embodiments, stem 110 can be any suitable size and/or shape. For example, in some embodiments, stem 110 can have an outer diameter of 0.3125 inches and/or a height in the range of 1.25 inches to 1.5 inches. When stem 110 is formed on center arm 406, shaft 104 can advantageously be used as another alignment tool when attached to stem 110 in some embodiments. Alternatively, stem 100 formed on heel arm 408 or toe arm 410 can provide more comfortable options for some right-handed or left-handed users, respectively.

In some embodiments, elements of golf putter 100, such as putter head 102 (402), leading portion 106, trailing portion 108 (404), stem 110, and shaft 104 can be constructed of any suitable material in any suitable manner. For example, in some embodiments, elements of golf putter 100 can be constructed of aluminum, titanium, hot rolled steel, cold rolled steel, and/or any other suitable material. In some embodiments, elements of golf putter 100 can be joined in any suitable manner. For example, in some embodiments, elements of golf putter 100 can be welded together and/or using any other suitable means.

The particular shape(s), dimension(s), and/or weight distribution(s) of putter head 102 and/or putter head 402 can allow golf putter 100 to be freestanding. In other words, a golfer can set the bottom side of putter head 102 or putter head 402 on the ground and release golf putter 100, and golf putter 100 will remain standing without falling over. This is advantageous to allow a golfer to set golf putter 100 adjacent to a golf ball, walk behind a golf ball and golf putter 100 to determine an appropriate target or trajectory, return to golf putter 100 to make aiming adjustments to the golf putter 100 as it stands adjacent to the golf ball, and repeat if necessary. More importantly, after the golfer has completed aiming and returns to the golf ball to attempt the putt, golf putter 100 is already aimed toward the appropriate target to strike the golf ball in the hole, and the golfer does not have to take aim based on a different viewing angle than from directly behind the ball.

Accordingly, putter heads and golf putters are provided.

Although the invention has been described and illustrated in the foregoing illustrative embodiments, it is understood that the present disclosure has been made only by way of example, and that numerous changes in the details of implementation of the invention can be made without departing from the spirit and scope of the invention, which is limited only by way of the claims that follow. Features of the disclosed embodiments can be combined and rearranged in various ways.

The invention claimed is:

1. A putter head for a freestanding golf putter, the putter head comprising:

a cylindrical leading portion comprising a heel end, a toe end, an axis that extends through a center of the heel end and a center of the toe end in a first direction, and a rounded exterior surface that extends from the heel end to the toe end, wherein the rounded exterior surface comprises a front face and a rear face, the rear face comprising a bottom part extending in the first direction from the heel end to the toe end; and a trailing portion comprising:

a center arm that extends rearwardly from a center portion of the bottom part of the rear face in a second direction that is perpendicular to the first direction;

a heel arm that extends rearwardly and inwardly towards the center arm from a first lateral portion of the bottom part of the rear face adjacent to the heel end;

a toe arm that extends rearwardly and inwardly towards the center arm from a second lateral portion of the bottom part of the rear face adjacent to the toe end; and a base at which the center arm, the heel arm, and the toe arm are integrally formed, wherein at least a portion of the front face forms a striking face for contacting a golf ball, wherein the center arm, the heel arm, the toe arm, and the base each lie in a same two-dimensional plane such that, when the putter head is placed on a putting surface, the two-dimensional plane is oriented parallel to the putting surface and the center arm, the heel arm, the to arm, and the base each contact the putting surface, wherein the center arm extends rearwardly in the second direction such that an end of the center arm is located a predetermined distance away from the center portion of the bottom part of the rear face, wherein the heel arm comprises a first outer lateral edge and a first rear edge connected to the first outer lateral edge and the end of the center arm, and the toe arm comprises a second outer lateral edge and a second rear edge connected to the second outer lateral edge and the end of the center arm, wherein the first outer lateral edge and the first rear edge intersect at a point located beyond the predetermined distance in the second direction, such that out surfaces of the first outer lateral edge and the first rear edge form a convex angel when viewed from a position facing the putter head and lying beyond the predetermined distance in the second direction, wherein the second outer lateral edge and the second rear edge intersect at a point located beyond the predetermined distance in the second direction, such that outer surfaces of the second outer lateral edge and the second rear edge form a convex angle when viewed from the position; and wherein the first rear edge and the second rear edge intersect at the end of the center arm, such that outer surfaces of the first rear edge and the second rear edge from a concave angle when viewed from the position.

2. The putter head of claim 1, wherein the first outer lateral edge, the first rear edge, the second rear edge, and the second outer lateral edge are straight edges.

3. The putter head of claim 1, further comprising a stem arranged on the center arm.

4. The putter head of claim 3, wherein the stem arranged on the center arm has a same height as a height of the cylindrical leading portion.

5. The putter head of claim 1, further comprising at least one alignment line arranged on at least one of the leading portion and the trailing portion and parallel to the second direction.

6. The putter head of claim 1, wherein the center arm, the heel arm, the toe arm, and the base have a height of 0.125 inch.

7. A freestanding golf putter comprising:

a putter head comprising:

a cylindrical leading portion comprising a heel end, a toe end, an axis that extends through a center of the heel end and a center of the toe end in a first direction, and a rounded exterior surface that extends from the heel end to the toe end, wherein the rounded exterior surface comprises a front face and a rear face, the rear face comprising a bottom part extending in the first direction from the heel end to the toe end; and a trailing portion comprising:

a center arm that extends rearwardly from a center portion of the bottom part of the rear face in a second direction that is perpendicular to the first direction;

a heel arm that extends rearwardly and inwardly towards the center arm from a first lateral portion of the bottom part of the rear face adjacent to the heel end;

a toe arm that extends rearwardly and inwardly towards the center arm from a second lateral portion of the rear face adjacent to the toe end; and a base at which the center arm, the heel arm, and the toe arm are integrally formed, wherein at least a portion of the front face forms a striking face for contacting a golf ball;

a stem arranged on the center arm; and a shaft coupled to the stem, wherein the center arm, the heel arm, the toe arm, and the base each lie in a same two-dimensional plane such that, when the putter head is placed on a putting surface, the two-dimensional plane is oriented parallel to the putting surface and the center arm, the heel arm, the to arm, and the base each contact the putting surface, wherein the center arm extends rearwardly in the second direction such that an end of the center arm is located a predetermined distance away from the center portion of the bottom part of the rear face, wherein the heel arm comprises a first outer lateral edge and a first rear edge connected to the first outer lateral edge and the end of the center arm, and the toe arm comprises a second outer lateral edge and a second rear edge connected to the second outer lateral edge and the end of the center arm, wherein the first outer lateral edge and the first rear edge intersect at a point located beyond the predetermined distance in the second direction, such that out surfaces of the first outer lateral edge and the first rear edge form a convex angel when viewed from a position facing the putter head and lying beyond the predetermined distance in the second direction, wherein the second outer lateral edge and the second rear edge intersect at a point located beyond the predetermined distance in the second direction, such that outer surfaces of the second outer lateral edge and the second rear edge form a convex angle when viewed from the position; and wherein the first rear edge and the second rear edge intersect at the end of the center arm, such that outer surfaces of the first rear edge and the second rear edge from a concave angle when viewed from the position.

8. The freestanding golf putter of claim 7, wherein the first outer lateral edge, the first rear edge, the second rear edge, and the second outer lateral edge are straight edges.

9. The freestanding golf putter of claim 7, wherein the stem is arranged on the center arm.

10. The freestanding golf putter of claim 9, wherein the stem arranged on the center arm has a same height as a height of the cylindrical leading portion.

11. The freestanding golf putter of claim 7, further comprising at least one alignment line arranged on at least one of the leading portion and the trailing portion and parallel to the second direction.

12. The freestanding golf putter of claim 7, wherein the center arm, the heel arm, the toe arm, and the base have a height of 0.125 inch.

* * * * *